US005404598A

United States Patent [19]

Hadsell

[11] Patent Number: 5,404,598

[45] Date of Patent: Apr. 11, 1995

[54] BATHTUB ADD ON HYDROTHERAPY APPARATUS

[76] Inventor: Richard McG. Hadsell, 5105 North Rd., Canandaigua, N.Y. 14425

[21] Appl. No.: 144,312

[22] Filed: Nov. 1, 1993

[51] Int. Cl.[6] ..... A61H 33/02

[52] U.S. Cl. ..... 4/541.4

[58] Field of Search ..... 4/541.1–541.6, 4/559; 601/154–158, 167

[56] References Cited

U.S. PATENT DOCUMENTS

| | | | |
|---|---|---|---|
| 3,273,560 | 9/1966 | Jacuzzi | 601/167 |
| 3,286,712 | 11/1966 | Roden | 4/541.4 X |
| 3,292,615 | 12/1966 | Bascomb et al. | 601/167 |
| 3,534,730 | 10/1970 | Jacuzzi | 601/167 |
| 3,961,382 | 6/1976 | Peterson | 4/541.4 |
| 4,100,917 | 7/1978 | Talge et al. | 4/541.2 |
| 4,933,999 | 6/1990 | Mikiya et al. | 4/568 |

FOREIGN PATENT DOCUMENTS

| | | | |
|---|---|---|---|
| 1513536 | 2/1968 | France | 601/167 |
| 3519363 | 12/1986 | Germany | 601/167 |

*Primary Examiner*—Charles E. Phillips

[57] ABSTRACT

A new and improved bathtub add on hydrotherapy apparatus includes an electrically powered water pump assembly located outside a bathtub and not supported by the bathtub. An intake element is placed below water level inside the bathtub. The intake element is connected to the water pump assembly through a first flexible hose. A valve assembly is connected to the electrically powered water pump assembly through a second flexible hose. The valve assembly includes a first valve unit for receiving water from the electrically powered water pump assembly through the second flexible hose. A first nozzle discharge assembly is connected to the valve assembly through a third flexible hose. The first nozzle discharge assembly discharges pumped water from the valve assembly into the bathtub. The first nozzle discharge assembly includes a first suction cup assembly for connecting the first nozzle discharge assembly to a selected location on an inner wall of the bathtub. The first nozzle discharge assembly also includes a first nozzle assembly connected to the first suction cup assembly which supports the first nozzle assembly on the inner wall of the bathtub. An air addition assembly, installed in the valve assembly, mixes air with water flowing though the valve assembly, such that air bubbles are formed in a water stream flowing through the valve assembly. A hand-held water massage assembly may be connected to the electrically powered water pump assembly through another flexible hose.

4 Claims, 4 Drawing Sheets

BATHTUB ADD ON HYDROTHERAPY APPARATUS

BACKGROUND OF THE INVENTION

1. Field of the Invention

The present invention relates generally to therapy units associated with a water tub, and more particularly, to a therapy unit designed to supply a stream of water or a flow of air bubbles into the water.

2. Description of the Prior Art

Therapy units designed to supply a stream of water, such as in a whirlpool bath, or a flow of air bubbles to water in a tub are well known. Generally, hydrotherapy is very relaxing after a physically or mentally stressful day. Hydrotherapy is helpful in preventing muscles from tightening. Special tubs equipped with a built-in array of water or air bubble ports are often called Jacuzzi's after the name of an inventor of such a device. Jacuzzis are most often large consumers of space. In addition, they are usually quite expensive to purchase and install. Some people might consider becoming a member of a health club to avoid the costs of expensive equipment, but the membership in the health club may also be quite expensive. Moreover, having desired equipment in one's home is much more convenient than requiring a trip to a health club. In this respect, it would be desirable if a whirlpool bath and air bubble administering device were provided for a conventional bathtub to retrofit the bathtub to become a bathtub that contained an internal whirlpool water stream and a flow of air bubbles.

People often have more than one bathtub in a residence. In this respect, it would be desirable if a whirlpool bath and air bubble administering device were provided for a bathtub that could easily be removed from one bathtub and carried to another and set up in another bathtub. The other bathtub could be in one person's house, or the other bathtub could be in the house of a friend.

With Jacuzzis that are built in to a water tub, an array of water nozzles and air bubble nozzles are also built in. Often, because of the positioning of a person in the tub with respect to the nozzles, much of the water stream or the air bubbles completely miss the person in the tub and are, in a sense, wasted. In this respect, it would be desirable if a whirlpool bath and air bubble administering device were provided for a water tub wherein water and air bubble nozzles could be positioned by the user of the tub to obtain optimum use of the water stream and air bubbles.

In built in Jacuzzis, often a large number of water and air bubble nozzles are provided. To supply an adequate water and air flow to the large number of nozzles, a relatively large pump is necessary. Such a relatively large pump is expensive and consumes relatively large amounts of electrical power. In this respect, it would be desirable if a device were provided for a water tub that employed a relatively small and inexpensive pump that consumed relatively small amounts of electrical power for supplying adequate water and air bubble flow.

With built in Jacuzzis, water and air bubble nozzles are generally fixed into the wall of tub. There is a disadvantage in using fixed nozzles because a person may have a localized spot on the body upon which water or air bubble treatment is desired, but that is difficult to place near a built in nozzle. In this respect, it would be desirable if a device were provided for a water tub which included water and air bubble nozzles that could be moved around for positioning near a part of a body of a user where water and air bubbles can be applied directly.

Another problem associated with a built in array of water flow and air bubble nozzles is that individual nozzles are not individually controllable. In this respect, it would be desirable if a device were provided in which individual nozzles had individual controls.

The following U.S. patents relating hydrotherapy units are known: U.S. Pat. Nos. 3,587,976; 4,127,117; 4,458,676; 4,853,987; and 5,056,168. More specifically, U.S. Pat. No. 3,587,976 discloses a hydrotherapy unit that includes a suction cup for installing a nozzle in a tub. The nozzle projects quite far into the tub and takes up quite an amount of tub space. In this respect, it would be desirable if an add on hydrotherapy device were provided for a tub that can be added on to the tub but that does not take up a lot of tub space. Moreover, with this device, a bubble-adding venturi sticks out from the water nozzle and takes up quite a bit of tub space. In this respect, it would be desirable if a bubbling device for a hydrotherapy device were provided for a tub that can be added on to the tub without taking up a lot of tub space.

U.S. Pat. No. 4,127,117 discloses a portable hydrotherapy bath assembly that fits onto the side wall of a tub. An electric motor is located within the assembly. U.S. Pat. No. 5,056,168 discloses a whirlpool bath which includes individual jet units, installed in the tub under water, each of which has an electrically powered pump. With the first device, there is always the danger that the unit will fall into a water filled tub and cause electrocution. With the second device, there is the danger that a water-tight seal will break, and water will contact the immersed electric motor. In this respect, it would be desirable if a hydrotherapy device were provided which precluded a danger of electrocution by precluding the possibility of an electric motor falling into a water filled tub.

U.S. Pat. No. 4,458,676 discloses a portable spa massager that has an adaptor to connect to a fluid jet nozzle in the wall of the therapeutic spa. Hooking up the massager unit to the wall nozzle takes the nozzle out of use for its normal therapeutic purposes. In this respect, it would be desirable if a massager unit were provided for a hydrotherapy device that did not put any of the water nozzles out of use to accommodate the massager.

U.S. Pat. No. 4,853,987 discloses a hydrotherapy jet and pump assembly that has nozzles installed through walls of a tub. A disadvantage of this device is that holes must be made in the walls of the tub. Once the units are installed in the tub, they cannot easily be removed. In essence, they become a built in device. In this respect, it would be desirable if an add on hydrotherapy device were provided that did not require making holes in the wall of the tub.

Thus, while the foregoing body of prior art indicates it to be well known to use hydrotherapy units added on to bathtubs, the prior art described above does not teach or suggest a bathtub add on hydrotherapy apparatus which has the following combination of desirable features: (1) retrofits the bathtub to become a bathtub that contains an internal whirlpool water stream and a flow of air bubbles; (2) can easily be removed from one bathtub and carried to another and set up in another bathtub; (3) wherein can be positioned by the user of the tub to obtain optimum use of the water stream and air bubbles; (4) provides a hydrotherapy unit that employs a relatively small and inexpensive pump that consumes relatively small amounts of electrical power for supplying adequate water and air bubble flow; (5) includes water and air bubble nozzles that can be moved around for positioning near a part of a body of a user where water and air bubbles can be applied directly; (6) provides individual nozzles which have individual controls; (7) can be added on to the tub but that does not take up a lot of tub space; (8) provides a bubbling device for a hydrotherapy unit for a tub that can be added on to the unit without taking up a lot of tub space; (9) precludes a danger of electrocution by precluding the possibility of an electric motor falling into a water filled tub; (10) does not put any of the water nozzles out of use to accommodate a massager; and (11) does not require making holes in the wall of the tub. The foregoing desired characteristics are provided by the unique bathtub add on hydrotherapy apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved bathtub add on hydrotherapy apparatus which includes an electrically powered water pump assembly located outside a bathtub and not supported by the bathtub. An intake element is placed below water level inside the bathtub. The intake element is connected to the electrically powered water pump assembly through a first flexible hose which conveys water in the bathtub through the intake element to the electrically powered water pump assembly. A valve assembly is connected to the electrically powered water pump assembly through a second flexible hose. The valve assembly includes a first valve unit for receiving water from the electrically powered water pump assembly through the second flexible hose. A first nozzle discharge assembly is connected to the valve assembly through a third flexible hose. The first nozzle discharge assembly discharges pumped water from the valve assembly into the bathtub. The first nozzle discharge assembly includes a first suction cup assembly for connecting the first nozzle discharge assembly to a selected location on an inner wall of the bathtub. The first nozzle discharge assembly also includes a first nozzle assembly connected to the first suction cup assembly which supports the first nozzle assembly on the inner wall of the bathtub.

The first nozzle assembly may be centrally located along a longitudinal axis that may be perpendicular to a center of the first suction cup assembly, such that when water may be discharged from the first nozzle assembly in a direction opposite to the first suction cup assembly, a reactive force generated by the discharged water which serves to exert pressure upon the first suction cup assembly for maintaining the first suction cup assembly in secure contact with the inner wall of the bathtub.

The valve assembly may include a connection assembly for attaching the valve assembly to a topside of a wall of the bathtub.

The first nozzle assembly may include a socket member and a ball member that may be retained in the socket member, such that the ball member can be rotated in the socket member for directing discharged water at a selected angle.

A second valve unit, in the valve assembly, receives water from the electrically powered water pump assembly through the second flexible hose. A second nozzle discharge assembly may be connected to the valve assembly through a fourth flexible hose. The second nozzle discharge assembly discharges pumped water from the valve assembly into the bathtub. The second nozzle discharge assembly may include a second suction cup assembly for connecting the second nozzle discharge assembly to a selected location on an inner wall of the bathtub. The second nozzle discharge assembly also may include a second nozzle assembly connected to the second suction cup assembly which supports the second nozzle assembly on the inner wall of the bathtub. The second nozzle assembly is centrally located along a longitudinal axis that may be perpendicular to a center of the second suction cup assembly, such that when water may be discharged from the second nozzle discharge assembly in a direction opposite to the second suction cup assembly, a reactive force may be generated by the discharged water which serves to exert pressure upon the second suction cup assembly for maintaining the second suction cup assembly in secure contact with the inner wall of the bathtub.

An air addition assembly, installed in the valve assembly, mixes air with water flowing though the valve assembly, such that air bubbles are formed in a water stream flowing through the valve assembly. The air addition assembly may include an adjustment assembly for adjusting an amount of air mixed with the flowing water for controlling an amount of air bubbles in the flowing water and carried to the first nozzle discharge assembly.

A hand-held water massage assembly may be connected to the electrically powered water pump assembly through a fifth flexible hose. The electrically powered water pump assembly provides a pumped flowing stream of water to the hand-held water massage assembly. The fifth flexible hose may be connected at a T-shaped water flow divider located on the second flexible hose. The hand-held water massage assembly may include a hand adjustable control assembly for controlling flow of water out of the hand-held water massage assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved bathtub add on hydrotherapy apparatus which has all of the advantages of the prior art and none of the disadvantages.

It is another object of the present invention to provide a new and improved bathtub add on hydrotherapy apparatus which may be easily and efficiently manufactured and marketed.

It is a further object of the present invention to provide a new and improved bathtub add on hydrotherapy apparatus which is of durable and reliable construction.

An even further object of the present invention is to provide a new and improved bathtub add on hydrotherapy apparatus which is susceptible of a low cost of manufacture with regard to both materials and labor, and which accordingly is then susceptible of low prices of sale to the consuming public, thereby making such bathtub add on hydrotherapy apparatus available to the buying public.

Still yet a further object of the present invention is to provide a new and improved bathtub add on hydrotherapy apparatus which retrofits the bathtub to become a bathtub that contains an internal whirlpool water stream and a flow of air bubbles.

Still another object of the present invention is to provide a new and improved bathtub add on hydrotherapy apparatus that can easily be removed from one bathtub and carried to another and set up in another bathtub.

Yet another object of the present invention is to provide a new and improved bathtub add on hydrotherapy apparatus which wherein can be positioned by the user of the tub to obtain optimum use of the water stream and air bubbles.

Even another object of the present invention is to provide a new and improved bathtub add on hydrotherapy apparatus that provides a hydrotherapy unit that employs a relatively small and inexpensive pump that consumes relatively small amounts of electrical power for supplying adequate water and air bubble flow.

Still a further object of the present invention is to provide a new and improved bathtub add on hydrotherapy apparatus which includes water and air bubble nozzles that can be moved around for positioning near a part of a body of a user where water and air bubbles can be applied directly.

Yet another object of the present invention is to provide a new and improved bathtub add on hydrotherapy apparatus that provides individual nozzles which have individual controls.

Still another object of the present invention is to provide a new and improved bathtub add on hydrotherapy apparatus which can be added on to the tub but that does not take up a lot of tub space.

Yet another object of the present invention is to provide a new and improved bathtub add on hydrotherapy apparatus provides a bubbling device for a hydrotherapy unit for a tub that can be added on to the unit without taking up a lot of tub space.

Still a further object of the present invention is to provide a new and improved bathtub add on hydrotherapy apparatus that precludes a danger of electrocution by precluding the possibility of an electric motor falling into a water filled tub.

Yet another object of the present invention is to provide a new and improved bathtub add on hydrotherapy apparatus which does not put any of the water nozzles out of use to accommodate a massager.

Still a further object of the present invention is to provide a new and improved bathtub add on hydrotherapy apparatus that does not require making holes in the wall of the tub.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
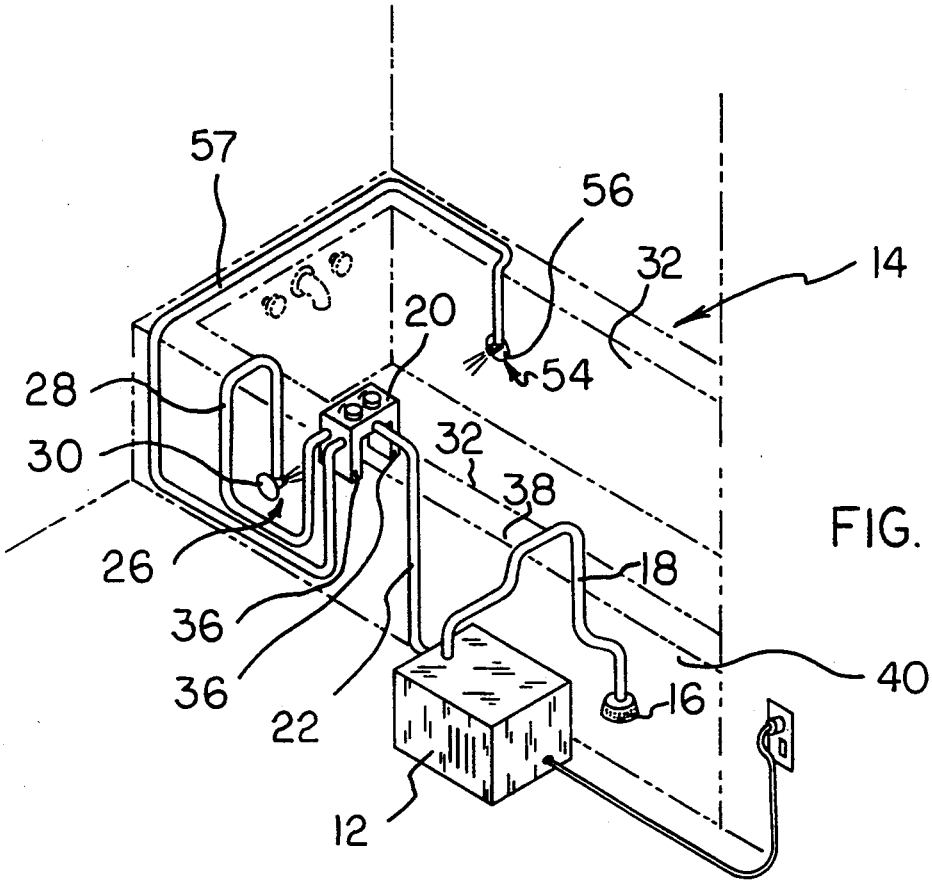
FIG. 1 is a perspective view showing a first preferred embodiment of the bathtub add on hydrotherapy apparatus of the invention installed on a bathtub.
Figure 2:
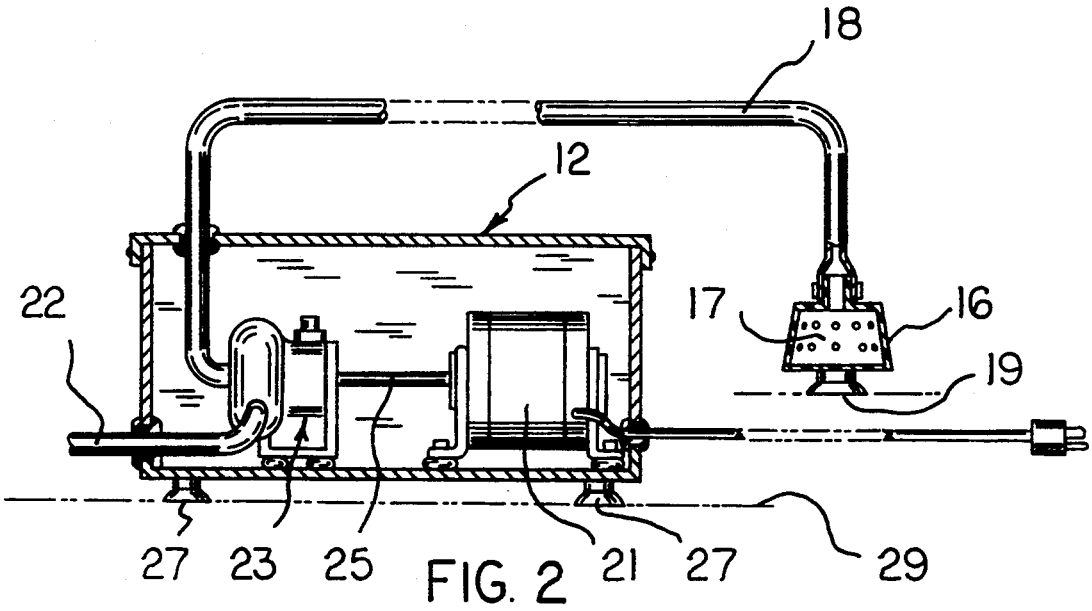
FIG. 2 is an enlarged cross-sectional side view of the electrically powered water pump assembly and the water intake element shown in FIG. 1.
Figure 3:
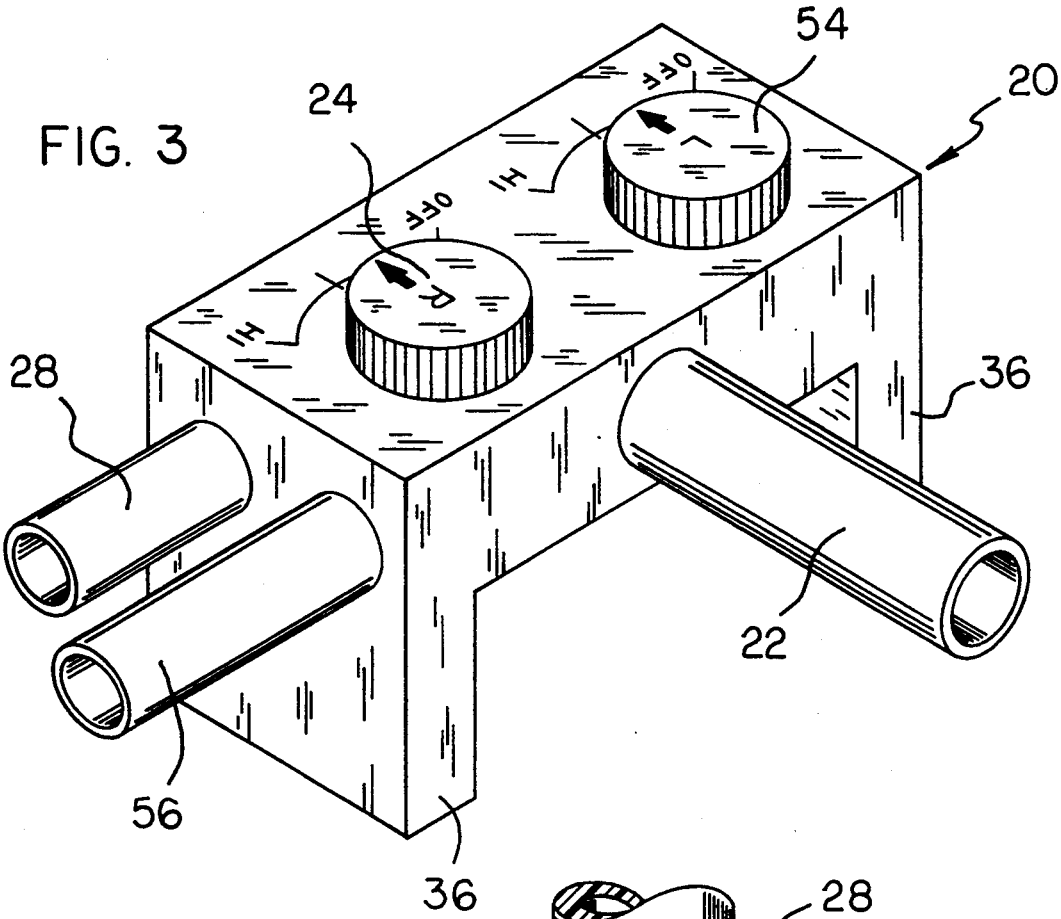
FIG. 3 is an enlarged perspective view of the valve assembly of the embodiment of the bathtub add on hydrotherapy apparatus of the invention shown in FIG. 1.
Figure 4:
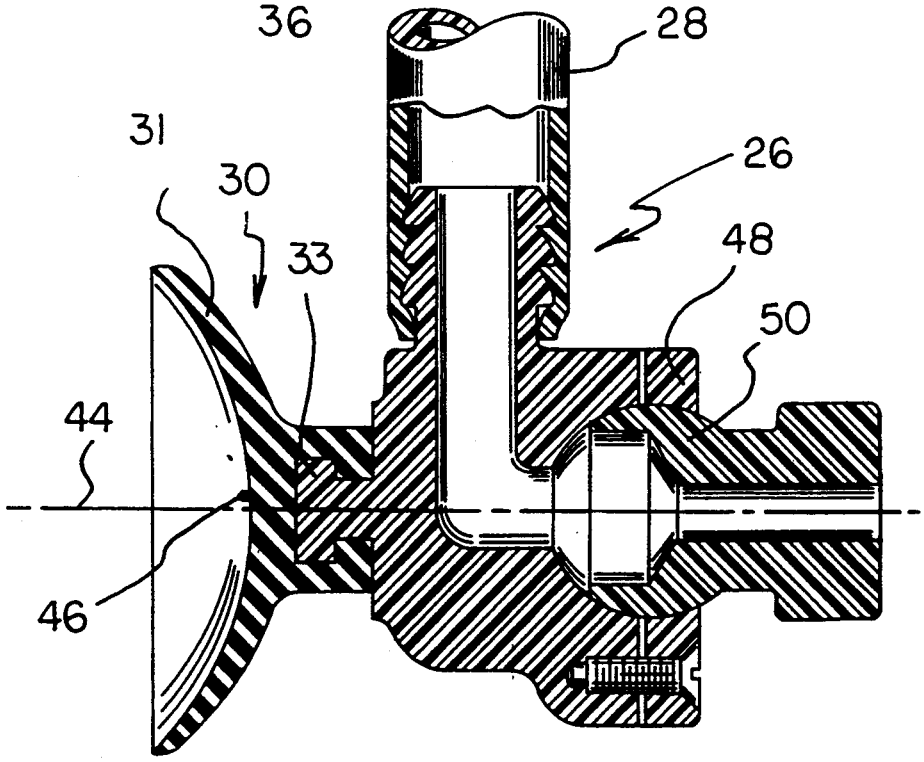
FIG. 4 is an enlarged cross-sectional side view of a suction cup assembly and a nozzle discharge assembly of the embodiment shown in FIG. 1.

With reference to the drawings, a new and improved bathtub add on hydrotherapy apparatus embodying the principles and concepts of the present invention will be described.

Turning initially to FIGS. 1–4, there is shown a first exemplary embodiment of the bathtub add on hydrotherapy apparatus of the invention generally designated by reference numeral 10. In its preferred form, bathtub add on hydrotherapy apparatus 10 includes an electrically powered water pump assembly 12 located outside a bathtub 14 and not supported by the bathtub 14. The electrically powered water pump assembly 12 is supported on a portion of the floor adjacent to the bathtub 14. In this way, it is virtually impossible for the electrically powered water pump assembly 12 to come in contact with the user occupying the tub. A ground fault eliminator can also be employed to further increase safety in a wet environment. The electrically powered water pump assembly 12 includes an electrically powered motor 21 and a water pump unit 23 connected by a shaft 25 to the motor 21.

Suction cups 27 are employed to fix the electrically powered water pump assembly 12 to a predetermined position on the floor 29 of the room. An intake element 16 is placed below water level inside the bathtub 14. The intake element 16 is connected to the electrically powered water pump assembly 12 through a first flexible hose 18 which conveys water in the bathtub 14 through the intake element 16 to the electrically powered water pump assembly 12. The intake element 16 includes a screen 17 or filter for screening objects, such as bars of soap, and preventing the screened objects from being drawn into the electrically powered water pump assembly 12. A suction cup 19 is located at the bottom of the intake element 16 for securing the intake element 16 to the floor of the bathtub 14.

A valve assembly 20 is connected to the electrically powered water pump assembly 12 through a second flexible hose 22. The valve assembly 20 includes a first valve unit 24 for receiving water from the electrically powered water pump assembly 12 through the second flexible hose 22. The first valve unit 24 can employ three settings for three levels of water flow off, low, and high.

A first nozzle discharge assembly 26 is connected to the valve assembly 20 through a third flexible hose 28. The first nozzle discharge assembly 26 discharges pumped water from the valve assembly 20 into the bathtub 14. The first nozzle discharge assembly 26 includes a first suction cup assembly 30 for connecting the first nozzle discharge assembly 26 to a selected location on an inner wall 32 of the bathtub 14. The first nozzle discharge assembly 26 also includes a first nozzle assembly 42 connected to the first suction cup assembly 30 which supports the first nozzle assembly 42 on the inner wall 32 of the bathtub 14. The first nozzle assembly 42 is centrally located along a longitudinal axis 44 that is perpendicular to a center 46 of the first suction cup assembly 30, such that when water is discharged from the first nozzle assembly 42 in a direction opposite to the first suction cup assembly 30, a reactive force generated by the discharged water which serves to exert pressure upon the first suction cup assembly 30 for maintaining the first suction cup assembly 30 in secure contact with the inner wall 32 of the bathtub 14.

The suction cup assembly 30 includes a replaceable suction cup element 31 and a support 33 for the suction cup element 31 located on the first nozzle discharge assembly 26. The water discharge from the first nozzle discharge assembly 26 can be regulated to control types of pulses that are conventionally used in hydrotherapy units. The control of the types of discharge can be located in the electrically powered water pump assembly 12 itself or in the valve assembly 20.

The valve assembly 20 includes a connection assembly 36 for attaching the valve assembly 20 to a topside 38 of a wall 40 of the bathtub 14. The connection assembly 36 is integrated into the structure of the valve assembly 20. The first nozzle assembly 42 includes a socket member 48 and a ball member 50 that is retained in the socket member 48, such that the ball member 50 can be rotated in the socket member 48 for directing discharged water at a selected angle. The valve assembly 20 receives water from the electrically powered water pump assembly 12 through the second flexible hose 22. A second nozzle discharge assembly 54 is connected to the valve assembly 20 through a fourth flexible hose 57. The second nozzle discharge assembly 54 discharges pumped water from the valve assembly 20 into the bathtub 14. The second nozzle discharge assembly 54 includes a second suction cup assembly 56 for connecting the second nozzle discharge assembly 54 to a selected location on an inner wall 32 of the bathtub 14. The second nozzle discharge assembly 54 also includes a second nozzle assembly 58 connected to the second suction cup assembly 56 which supports the second nozzle assembly 54 on the inner wall 32 of the bathtub 14.

The second nozzle assembly 54, in a way similar to the first nozzle assembly 42, is centrally located along a longitudinal axis 44 that is perpendicular to a center 46 of the second suction cup assembly 56, such that when water is discharged from the second nozzle discharge assembly 54 in a direction opposite to the second suction cup assembly 56, a reactive force is generated by the discharged water which serves to exert pressure upon the second suction cup assembly 56 for maintaining the second suction cup assembly 56 in secure contact with the inner wall 32 of the bathtub 14.

Figure 5:
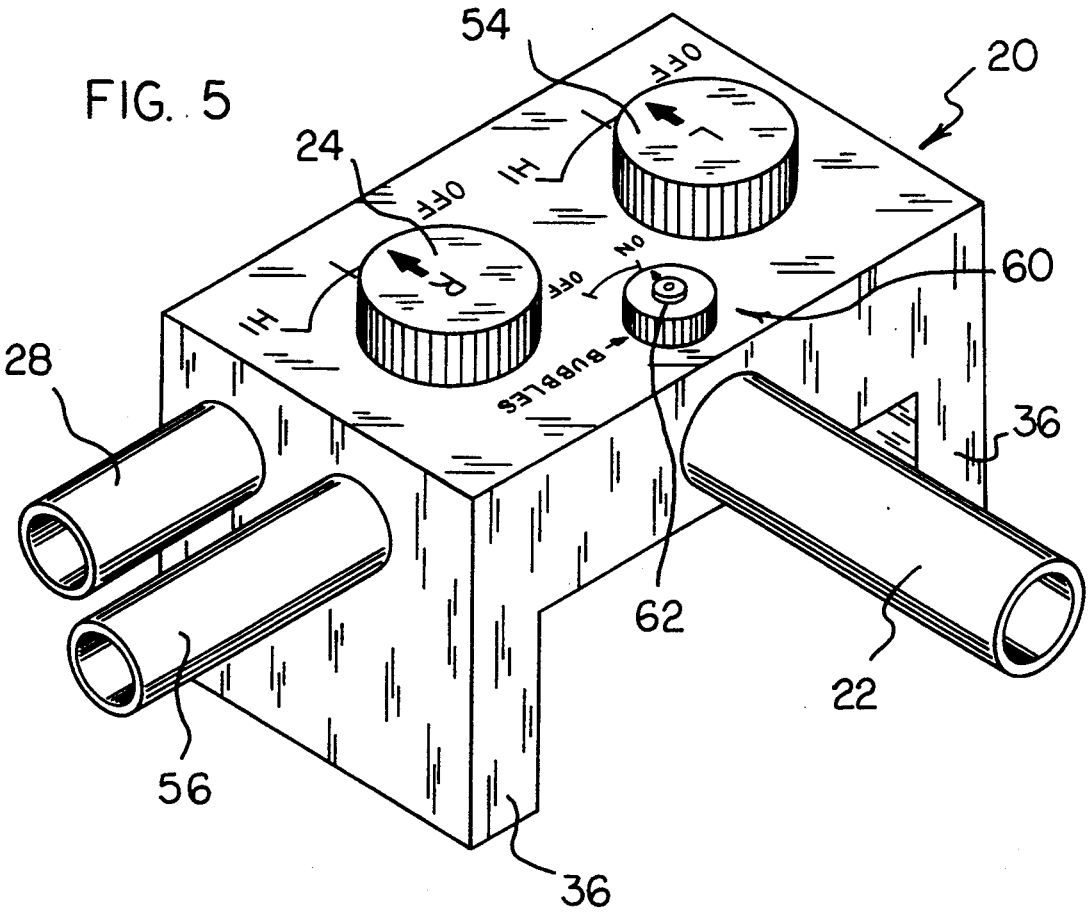
FIG. 5 is an enlarged perspective view of the valve assembly of a second preferred embodiment of the bathtub add on hydrotherapy apparatus of the invention shown which includes an air addition assembly for providing air bubbles to the water flow through the nozzle discharge assembly.
Figure 6:
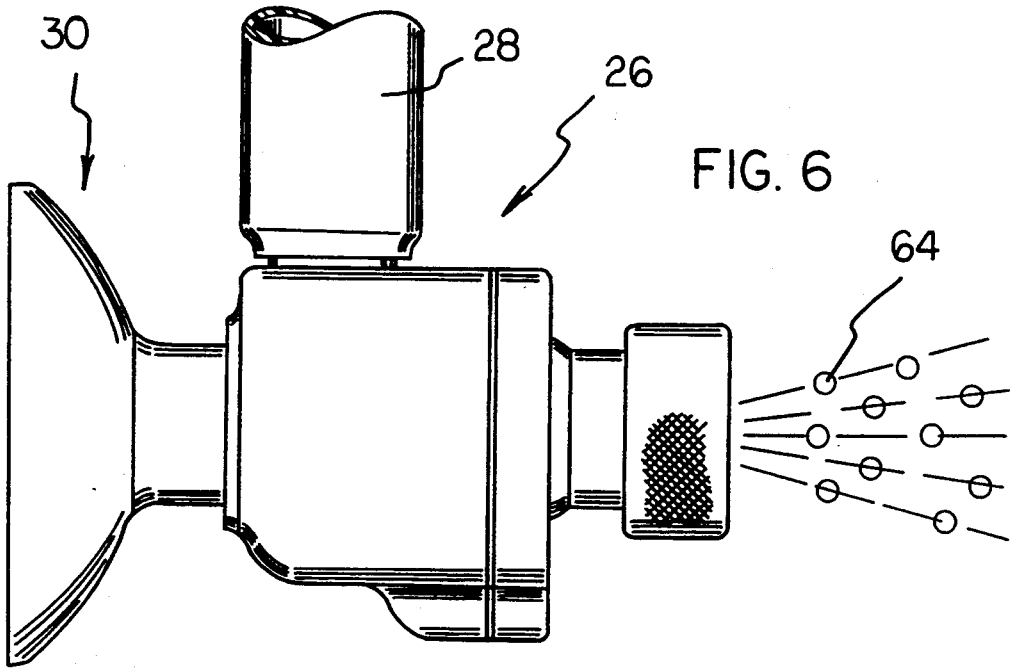
FIG. 6 is an enlarged side view of a suction cup assembly and a nozzle discharge assembly used with the embodiment of the invention shown in FIG. 5 showing air bubbles being discharged.

Turning to FIGS. 5–6, a second embodiment of the invention is shown. Reference numerals are shown that correspond to like reference numerals that designate like elements shown in the other figures. In addition, an air addition assembly 60, installed in the valve assembly 20, mixes air with water flowing though the valve assembly 20, such that air bubbles are formed in a water stream flowing through the valve assembly 20. The air addition assembly 60 includes a venturi for adding air to the water flow through the valve assembly 20.

The air addition assembly 60 includes an adjustment assembly 62 for adjusting an amount of air mixed with the flowing water for controlling an amount of air bubbles 64 in the flowing water and carried to the first nozzle discharge assembly 26. The adjustment assembly 62 includes an adjustable valve for controlling the amount or air added to the flowing water.

Figure 7:
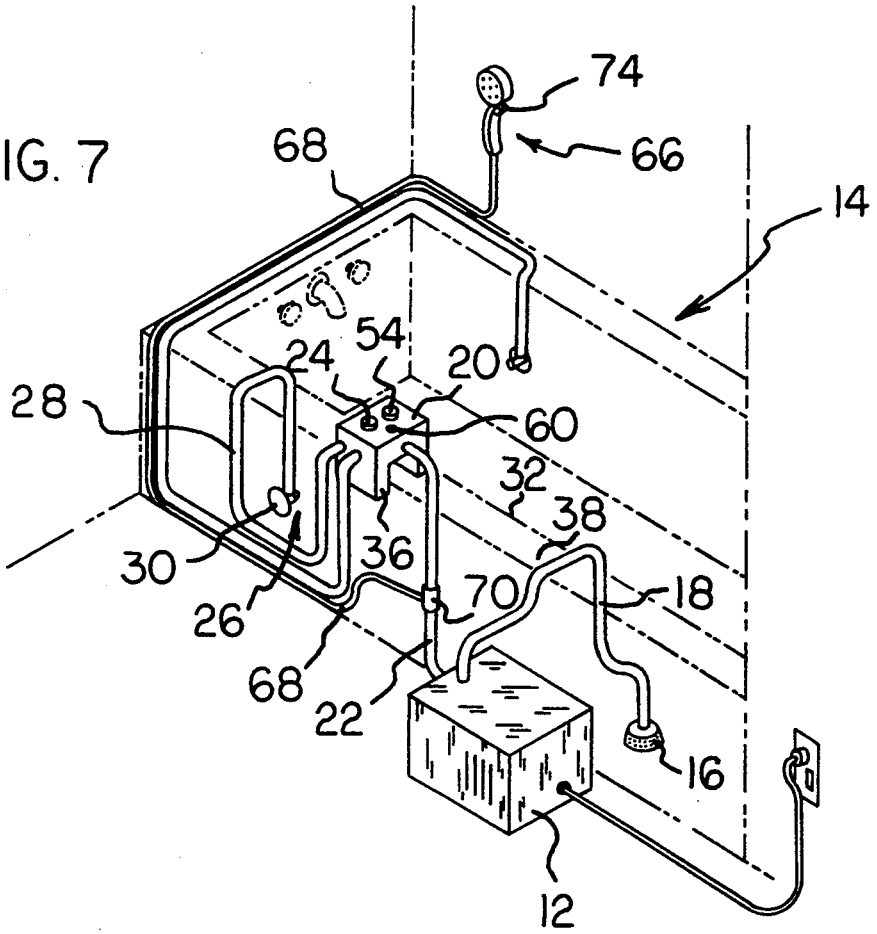
FIG. 7 is a perspective view showing a third preferred embodiment of the bathtub add on hydrotherapy apparatus of the invention installed on a bathtub wherein the embodiment includes a hand-held water massage assembly.
Figure 8:
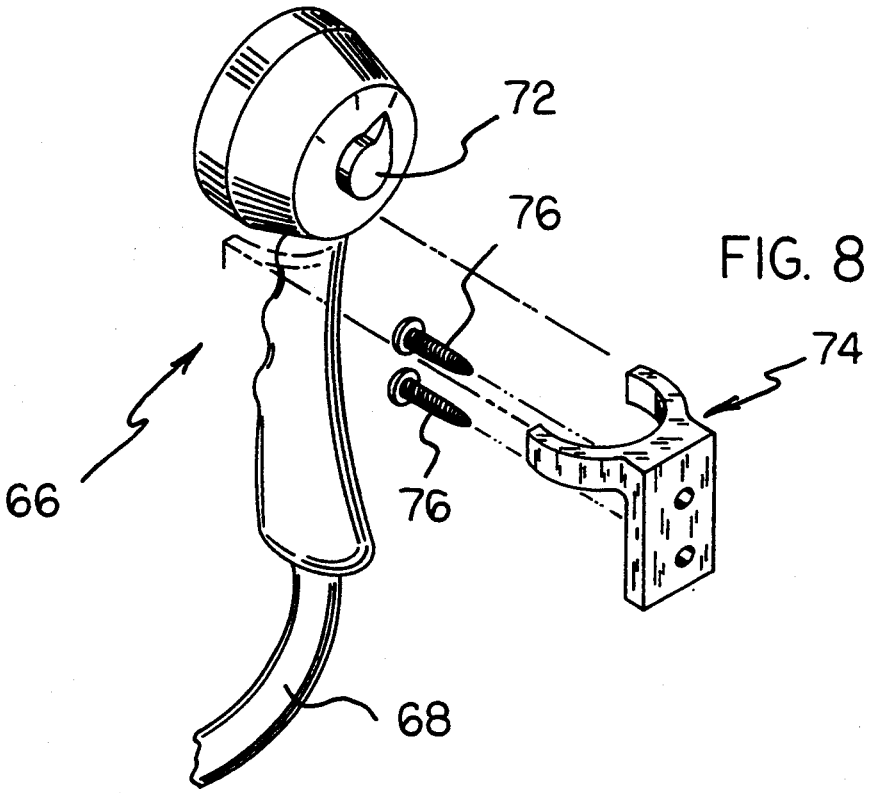
FIG. 8 is an enlarged perspective view of the hand-held water massage assembly shown in FIG. 7.

Turning to FIGS. 7–8, a third embodiment of the invention is shown. Reference numerals are shown that correspond to like reference numerals that designate like elements shown in the other figures. In addition, a hand-held water massage assembly 66 is connected to the electrically powered water pump assembly 12 through a fifth flexible hose 68. The electrically powered water pump assembly 12 provides a pumped flowing stream of water to the hand-held water massage assembly 66.

The fifth flexible hose 68 is connected at a T-shaped water flow divider 70 located on the second flexible hose 22. The water flowing to the hand-held water massage assembly 66 bypasses the valve assembly 20, and, thereby bypasses addition of bubbles.

The hand-held water massage assembly 66 includes a hand adjustable control assembly 72 for controlling flow of water out of the hand-held water massage assembly 66. The hand adjustable control assembly 72 can regulate the water flow to be a smooth stream, or the flow of water can be pulsed as is well known in water massagers. A wall bracket assembly 74 is used to support the hand-held water massage assembly 66 on a wall location. Screws 76 are used to attach the wall bracket assembly 74 to the wall.

The bathtub add on hydrotherapy apparatus of the invention is portable. As such it can readily be taken along to such places as summer camps; or it can be loaned to people for use in their homes. When the bathtub add on hydrotherapy apparatus is not in use, it can readily be packed into a small case and stored in a closet or in a sink cabinet.

Other than the pump, the components of the bathtub add on hydrotherapy apparatus of the invention can be made from inexpensive and durable plastic materials.

It is apparent from the above that the present invention accomplishes all of the objects set forth by providing a new and improved bathtub add on hydrotherapy apparatus that is low in cost, relatively simple in design and operation, and which retrofits the bathtub to become a bathtub that contains an internal whirlpool water stream and a flow of air bubbles. With the invention, a bathtub add on hydrotherapy apparatus is provided which can easily be removed from one bathtub and carried to another and set up in another bathtub. With the invention, a bathtub add on hydrotherapy apparatus is provided which can be positioned by the user of the tub to obtain optimum use of the water stream and air bubbles. With the invention, a bathtub add on hydrotherapy apparatus is provided which provides a hydrotherapy unit that employs a relatively small and inexpensive pump that consumes relatively small amounts of electrical power for supplying adequate water and air bubble flow. With the invention, a bathtub add on hydrotherapy apparatus is provided which includes water and air bubble nozzles that can be moved around for positioning near a part of a body of a user where water and air bubbles can be applied directly. With the invention, a bathtub add on hydrotherapy apparatus is provided which has individually controlled nozzles. With the invention, a bathtub add on hydrotherapy apparatus is provided which can be added on to the tub but that does not take up a lot of tub space. With the invention, a bathtub add on hydrotherapy apparatus provides a bubbling device for a hydrotherapy unit for a tub that can be added on to the unit without taking up a lot of tub space. With the invention, a bathtub add on hydrotherapy apparatus is provided which precludes a danger of electrocution by precluding the possibility of an electric motor falling into a water filled tub. With the invention, a bathtub add on hydrotherapy apparatus is provided which does not put any of the water nozzles out of use to accommodate a massager. With the invention, a bathtub add on hydrotherapy apparatus is provided which does not require making holes in the wall of the tub.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved bathtub add on hydrotherapy apparatus, comprising:

an electrically powered water pump assembly located outside a bathtub and not supported by the bathtub, an intake element, placed below water level inside the bathtub and supported by a floor of the bathtub, said intake element being connected to said electrically powered water pump assembly through a first flexible hose, for conveying water in the bathtub through said intake element to said electrically powered water pump assembly, a valve assembly including a first valve unit for receiving water from said electrically powered water pump assembly through said second flexible hose, said valve unit having means to interrupt and regulate water flow therethrough, wherein said valve assembly includes connection assembly means for attaching said valve assembly to a topside of a wall of the bathtub, a first nozzle discharge assembly, connected to said valve assembly through a third flexible hose, said first nozzle discharge assembly for discharging pumped water from said valve assembly into the bathtub, said first nozzle discharge assembly including a first suction cup assembly for connecting said first nozzle discharge assembly to a selected location on a first inner wall of the bathtub, said first nozzle discharge assembly also including a first nozzle assembly connected to said first suction cup assembly which is adapted for supporting said first nozzle assembly on the first inner wall of the bathtub, said first nozzle assembly being centrally located along a longitudinal axis that is perpendicular to a center of said first suction cup assembly, such that when water is discharged from said first nozzle assembly in a direction opposite to said first suction cup assembly, a reactive force generated by the discharged water serves to exert pressure upon said first suction cup assembly for maintaining said first suction cup assembly in secure contact with the inner wall of the bathtub, and a second nozzle discharge assembly, connected to said valve assembly through a fourth flexible hose, said second nozzle discharge assembly for discharging pumped water from said valve assembly into the bathtub, said second nozzle discharge assembly including a second suction cup assembly which is adapted for connecting said second nozzle discharge assembly to a selected location on a second inner wall of the bathtub in a location opposite said first nozzle discharge assembly on the first inner wall of the bathtub, said second nozzle discharge assembly also including a second nozzle assembly connected to said second suction cup assembly which is adapted to support said second nozzle assembly on the second inner wall of the bathtub, said second nozzle assembly being centrally located along a longitudinal axis that is perpendicular to a center of said second suction cup assembly, such that when water is discharged from said second nozzle discharge assembly in a direction opposite to said second suction cup assembly, a reactive force generated by the discharged water serves to exert pressure upon said second suction cup assembly for maintaining said second suction cup assembly in secure contact with the second inner wall of the bathtub, wherein said first nozzle discharge assembly is located opposite to said second nozzle discharge assembly.

2. The apparatus described in claim 1, further including:

air addition assembly means, installed in said valve assembly, for mixing air with water flowing though said valve assembly, such that air bubbles are formed in a water stream flowing through said valve assembly.

3. The apparatus described in claim 2 wherein said air addition assembly means include adjustment assembly means for adjusting an amount of air mixed with the flowing water for controlling an amount of air bubbles in the flowing water and carried to said first nozzle discharge assembly.

4. The apparatus described in claim 1 wherein said first nozzle assembly includes a socket member and a ball member that is retained in said socket member, such that said ball member can be rotated in said socket member for directing discharged water at a selected angle.

* * * * *